United States Patent [19]

Lamberth

[11] 4,383,708

[45] May 17, 1983

[54] LOCKING DEVICE FOR SLIDING CLOSURE UNIT

[76] Inventor: Eugene Lamberth, 4244 Overlook Dr., Birmingham, Ala. 35222

[21] Appl. No.: 208,534

[22] Filed: Nov. 20, 1980

[51] Int. Cl.[3] ..... E05C 17/12

[52] U.S. Cl. ..... 292/204; 292/DIG. 46

[58] Field of Search ..... 292/204, DIG. 9, DIG. 46, 292/202, 207, 209, 210; 49/388

[56] References Cited

U.S. PATENT DOCUMENTS 3,622,190 11/1971 Mohun ..... 292/DIG. 46 X
3,778,932 12/1973 Ewing ..... 49/388
3,837,693 9/1974 Adickes ..... 292/DIG. 9 X
3,927,906 12/1975 Mieras ..... 292/DIG. 46 X
4,275,940 6/1981 Draper ..... 292/DIG. 46 X

FOREIGN PATENT DOCUMENTS 1085342 9/1967 United Kingdom ..... 49/388

*Primary Examiner*—Richard E. Moore
*Attorney, Agent, or Firm*—Woodford R. Thompson, Jr.

[57] ABSTRACT

A locking device for a sliding closure unit having two panels, at least one of which is slidable, embodies an elongated stop member which is pivotally connected to one panel in position to rotate selectively to an inoperative position to permit relative movement of the panels and to an operative position to limit relative movement of the panels.

4 Claims, 10 Drawing Figures

LOCKING DEVICE FOR SLIDING CLOSURE UNIT

BACKGROUND OF THE INVENTION

This invention relates to locks for sliding closure units and more particularly to a pivotally mounted lock that positively limits sliding movement of at least one movable panel of a sliding closure unit.

Heretofore in the art to which my invention relates little success has been achieved in providing locking devices for sliding closure units, such as sliding door units, horizontal and vertical sliding window units and the like. That is, some of these units may be lifted relative to the grooves in which they slide or may be easily forced apart until the conventional locking devices used thereon disengages.

Examples of such conventional devices used include installing protruding screws into the grooves over the sliding panels or by placing a broom handle, pipe, rod or the like in the bottom groove for the panels. Such devices present an unsightly appearance and are easily lost or misplaced. Also, pins have been inserted at the interface of the two panels to prevent relative movement of the sliding panel. Where such a pin is used a hacksaw blade may be inserted through the gap between the panels to cut the pin. Other locking devices are illustrated in U.S. Pat. Nos. 4,135,376 and 3,328,920 in which a locking bar is hingedly connected to one door whereby it may be pivoted into position to limit movement of the sliding door.

SUMMARY OF THE INVENTION

In accordance with my invention, I provide a pivotally mounted door lock which is simple of construction, economical in its manufacture and easily installed. Also, it is neat in appearance. My improved sliding closure unit lock embodies an elongated stop member carried by the end frame members of one panel of the unit with the stop member being adapted to pivot selectively to an inoperative position alongside the panel carrying the same to permit free sliding movement of the other panel and to an operative position with a portion of the stop member extending into position to limit sliding movement of the other panel.

DESCRIPTION OF THE DRAWINGS

Apparatus embodying features of my invention is illustrated in the accompanying drawings, forming a part of this application, in which.

DETAILED DESCRIPTION

Figure 1:
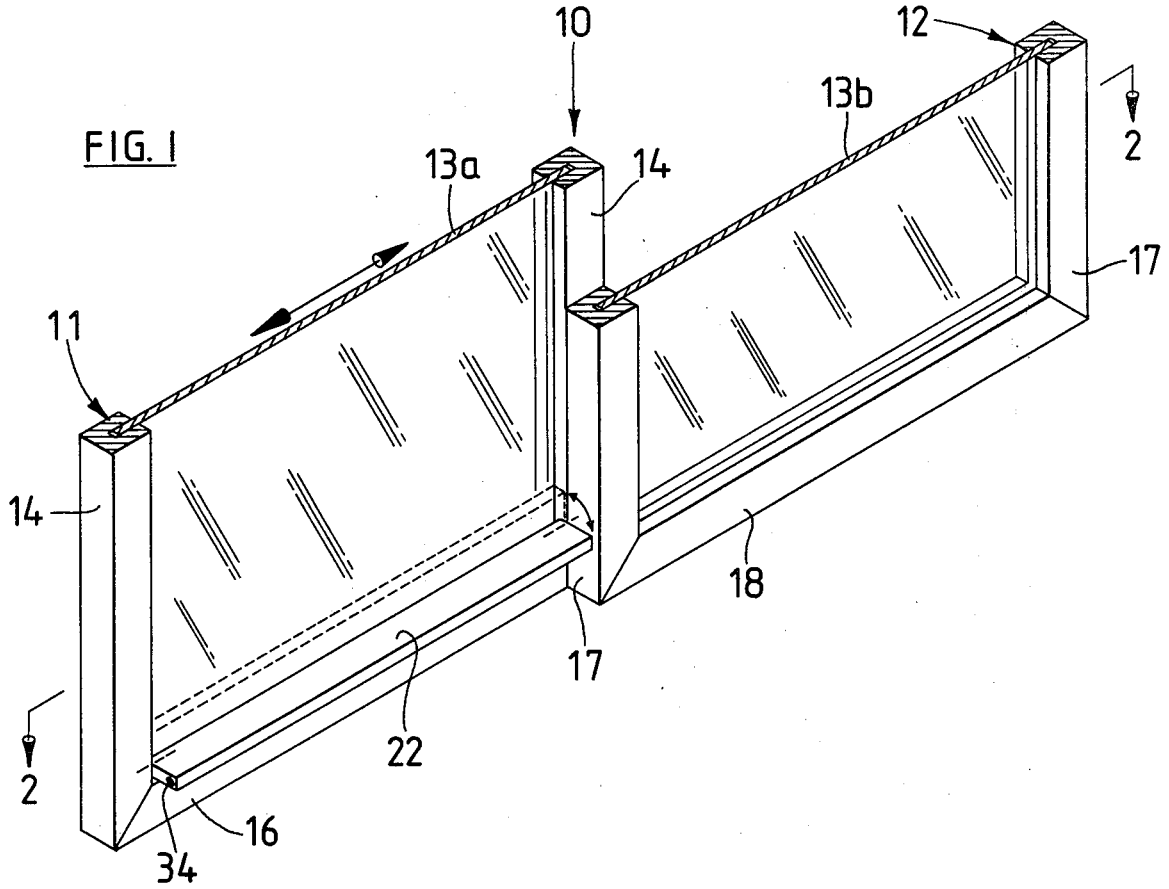
FIG. 1 is a fragmental perspective view showing the sliding panels closed with the stop member carried by the movable panel in the operative position.

Referring now to the drawings for a better understanding of my invention, I show in FIG. 1 my improved locking device used with a sliding door unit 10 of the type having a movable door panel 11 and a stationary or fixed door panel 12. The movable door panel 11 is shown as having a glass panel 13$^a$ encased in pairs of oppositely disposed vertical end frame members 14 and horizontal end frame members 16. The stationary door panel 12 is shown as having a glass panel 13$^b$ encased in vertical end frame members 17 and horizontal end frame members 18.

Figure 2:
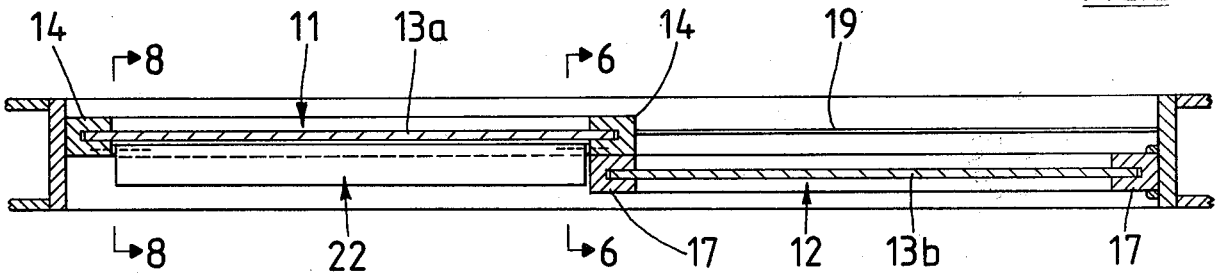
FIG. 2 is a horizontal sectional view taken generally along the line 2—2 of FIG. 1.
Figure 3:
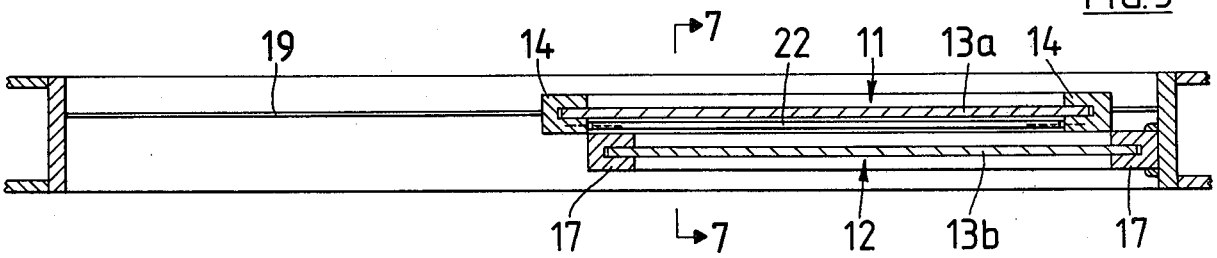
FIG. 3 is a horizontal sectional view corresponding to FIG. 2 showing the stop member in its inoperative position with the movable panel open.
Figure 4:
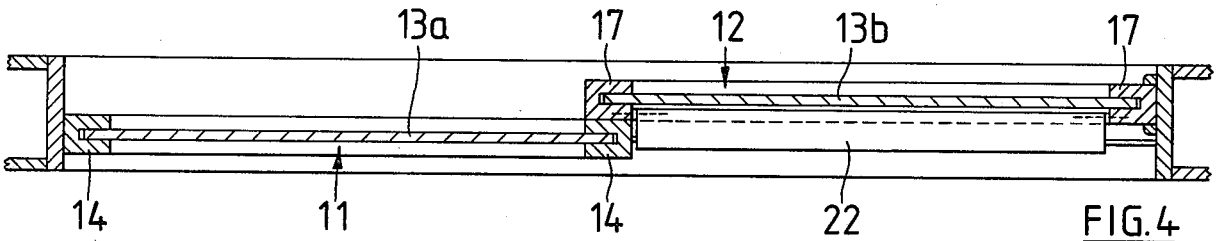
FIG. 4 is a horizontal sectional view showing the movable panel closed and riding on the inside track with the stop member carried by the stationary panel.
Figure 5:
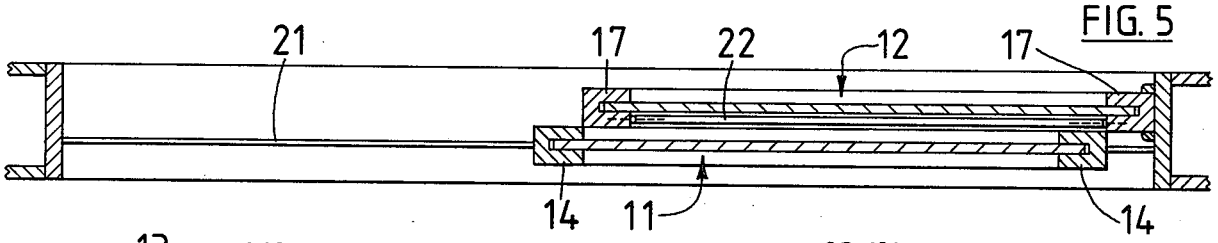
FIG. 5 is a horizontal sectional view corresponding to FIG. 4 showing the stop member in the inoperative position with the movable panel open.

As is well known, sliding door units are usually of two different types. FIGS. 1, 2 and 3 show a first type wherein the movable door panel 11 rides on an outside track 19 while FIGS. 4 and 5 show a second type wherein the movable door panel 11 rides on an inside track 21. While I have shown the vertical panels 13$^a$ and 13$^b$ as being glass panels, it will be understood that such panels may be formed of other materials, such as wood, metal or the like. Also, my improved locking device may be adapted for use with vertical and horizontal sliding window units and sliding door units having two panels movable relative to each other.

FIGS. 1, 2 and 3 show an elongated stop member 22 extending between and pivotally connected at its end to vertical end frame members 14 of the movable door panel 11. The elongated stop member 22 may be in the form of an elongated bar-like member or the like, which is adapted to rotate about a longitudinal axis which is offset relative to the longitudinal center of the stop member. The stop member 22 is thus rotatable selectively to an inoperative position extending upwardly alongside the vertical panel 13$^a$ and to an operative position with a portion of the stop member 22 extending laterally into position to engage the adjacent vertical frame member 17 of the stationary door panel 12. That is, while in the inoperative position as shown in FIG. 3, the stop member 22 permits free sliding movement of the movable door panel 11, as shown in FIGS. 1 and 2.

Figure 6:
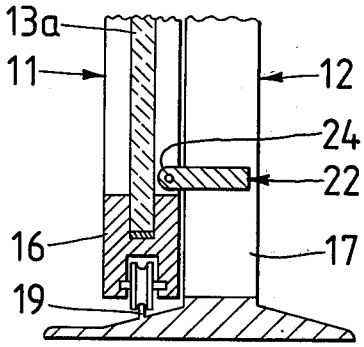
FIG. 6 is an enlarged, fragmental sectional view taken generally along the line 6—6 of FIG. 2.
Figure 7:
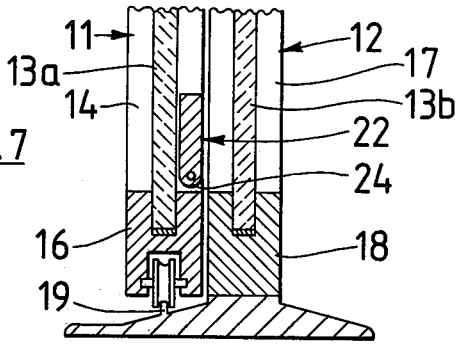
FIG. 7 is an enlarged, fragmental sectional view taken generally along the line 7—7 of FIG. 3.
Figure 8:
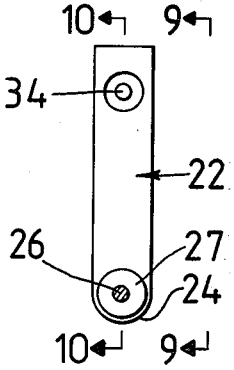
FIG. 8 is an enlarged end view of the stop member taken generally along the line 8—8 of FIG. 2.

The inoperative position of the stop member 22 is best shown in FIG. 7 and the operative position is best shown in FIGS. 1 and 6.

Figure 10:
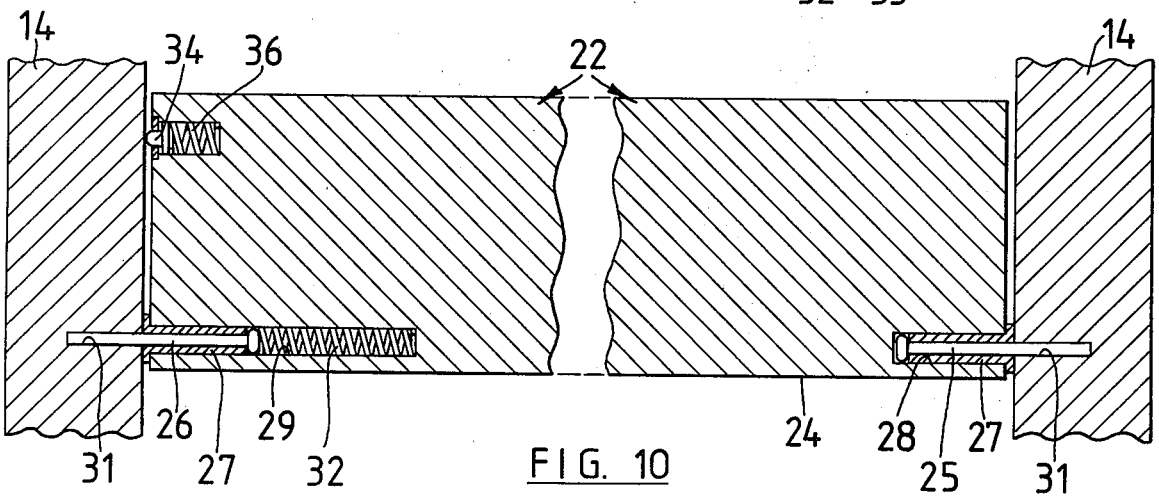
FIG. 10 is a vertical sectional view taken generally along the line 10—10 of FIG. 8, partly broken away.

Preferably, the elongated stop member 22 is generally rectangular as viewed in cross section and has one longitudinally extending arcuate edge 24, as shown in cross section in FIGS. 6 and 7. The arcuate edge 24 extends alongside the panel 13$^a$ when the stop member 22 is in the operative position as shown in FIG. 6. The ends of the stop member 22 are pivotally connected adjacent the arcuate edge 24 to the vertical frame members 14 adjacent thereto, as shown in FIG. 10. This offset of the axis of rotation of the stop member 22 provides clearance for the stop member 22 to rotate selectively to its operative and inoperative positions, respectively.

Figure 9:
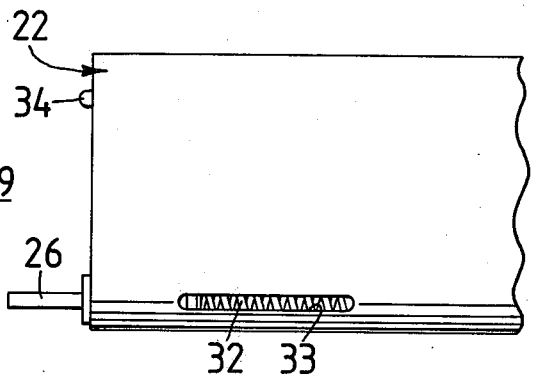
FIG. 9 is a fragmental, side elevational view taken generally along the line 9—9 of FIG. 8.

Pin-like member 25 and 26 are carried by the opposite ends of the stop member 22 as shown in FIGS. 9 and 10. Each pin-like member 25 and 26 is carried by an elongated retainer sleeve 27 which is inserted into axially extending openings 28 and 29, respectively, provided in the ends of the stop member 22, as shown. A longitudinally extending opening 31 is provided in each vertical frame member 14 in position to receive the axially extending end portion of the pin-like member adjacent thereto as shown in FIG. 10. A spring 32 is carried by the opening 29 in position to urge the pin-like member 26 toward the adjacent opening 31, thus forming a spring loaded pin-like member 26 as shown.

An elongated slot 33 is provided in the stop member 22 in longitudinal alignment with the opening 29 in position to receive a tool for depressing the spring 32 to disconnect the spring loaded pin-like member 26 from the adjacent vertical frame member 14. While I have shown only one spring loaded pin-like member 26, it will be apparent that a spring loaded pin-like member could be provided at each end of the stop member 22. Also, the stop member 22 may be assembled within the door unit during manufacture wherein both pins 25 and 26 could be fixed pins such as the pin-like member 25 carried by the recess 28.

A releasable catch in the form of a movable member 34 projects from one end of stop member 22 in position to engage the adjacent surface of one of the vertical end frame members 14 as shown in FIG. 10. This frictional engagement retains the stop member 22 in the inoperative position until it is rotated to the operative, locking position. If desired, a suitable recess may be provided in the adjacent end frame member 14 for receiving the member 34. Resilient means such as a compression spring 36 is interposed between the stop member 22 and the movable member 34 for urging the movable member 34 toward the adjacent vertical frame member 14. While I have shown only one releasable catch, it will be obvious that a releasable catch could be mounted at each end of the stop member 22. Also, the releasable catch could be in other forms.

From the foregoing, the operation of my improved sliding door lock adapted for use with the sliding door unit 10 shown in FIGS. 1, 2 and 3 will be readily understood. First, the opening 31 is formed in each vertical end frame member 14 as shown. Next, the stop member 22 carrying the pin-like members 25 and 26 at opposite ends is placed between the vertical frame members 14 in position for the pin-like members to be inserted into the openings 31 as shown in FIG. 10. The stop member 22 is then supported for rotation to and from its operative, locking position as shown in FIGS. 1 and 2. When it is desired to position the stop member 22 in the inoperative position, the user simply pivots it to the vertical position shown in FIG. 7. The movable member 34, urged by the spring 36, then engages an adjacent vertical end frame member 14 to hold it in place.

FIGS. 4 and 5 show the stop member 22 carried by the fixed or stationary door 12. The stop member 22 is pivotally connected at its ends to the vertical end frame members 17 of the stationary door 12 in the same manner as the stop member 22 is connected to the vertical frame members 14 of the movable door panel 11, described hereinabove. That is, pin-like members are carried by each end of the stop member 22 in position to telescope into longitudinally extending openings provided in each vertical frame member 17.

From the foregoing, the operation of my improved lock adapted for use with the sliding door unit 10 shown in FIGS. 4 and 5 will be readily understood. First, the openings 31 are formed in the vertical end frame members 17. Next, the stop member 22 carrying the pin-like members 25 and 26 at opposite ends thereof, is placed between the vertical frame members 17 and in position for the pin-like members to telescope into the openings 31. The stop member 22 is then supported for rotation to and from its operative locking position, as described above. Upon rotation of the stop member 22 to its inoperative position it is then retained in place by the releasable catch which engages the adjacent vertical end frame member 17.

From the foregoing, it will be seen that I have devised an improved lock for a sliding closure unit which is extremely simple of construction, economical of manufacture and which may be installed with a minimum of effort by unskilled labor. Also, my improved lock is very neat in appearance and at the same time provides a positive lock for various types of sliding closure units, such as sliding glass door units having fixed and movable panels, sliding door units having two panels movable relative to each other, and horizontal and vertical sliding window units.

While I have shown my invention in but one form, it will be obvious to those skilled in the art that it is not so limited, but is susceptible of various changes and modifications without departing from the spirit thereof.

What I claim is:

1. In a locking device for use with a sliding closure unit having a first vertical panel and a second vertical panel with each panel having end frame members, said locking device comprising:

(a) an elongated stop member extending between and pivotally connected at its ends to the end frame members of one panel with said stop member being rotatable selectively to an inoperative position alongside said one panel to permit free sliding movement of the other panel and to an operative position with a portion of said stop member extending laterally into position to limit sliding movement of said other panel, and (b) releasable catch means detachably connecting said stop member to at least one end frame member of said one panel to retain said stop member in its inoperative position.

2. A locking device as defined in claim 1 in which said catch means comprises:

(a) a movable member projecting from at least one end of said stop member and extending toward a frame member of said one panel adjacent thereto, and (b) resilient means urging said movable member toward said frame member adjacent thereto.

3. A locking device as defined in claim 2 in which said resilient means is a spring member interposed between said movable member and said stop member.

4. In a locking device for use with a sliding closure unit having a first vertical panel and a second vertical panel with each panel having end frame members, said locking device comprising:

(a) an elongated stop member extending between and pivotally connected at its ends to the end frame members of one panel with said stop member being rotatable selectively to an inoperative position alongside said one panel to permit free sliding movement of the other panel and to an operative position with a portion of said stop member extending laterally into position to limit sliding movement of said other panel, (b) an elongated pin-like member carried by and projecting from each end of said stop member adjacent one longitudinal edge thereof with each said pin-like member extending toward an adjacent end frame member of said one panel, (c) there being an opening in each end frame member of said one panel in position to receive said pin-like member adjacent thereto, (d) there being an elongated recess in at least one end of said stop member adapted to receive one pin-like member with a sliding fit, (e) a compression spring carried by said elongated recess urging said one pin-like member axially toward said opening adjacent thereto with said one pin-like member being releasable from said opening adjacent thereto upon inward movement of said one pin-like member, and (f) there being an elongated slot in said stop member in longitudinal alignment with said elongated recess in position to receive a tool for depressing said compression spring.

* * * * *